United States Patent [19]

Erikson

[11] Patent Number: 4,763,902

[45] Date of Patent: Aug. 16, 1988

[54] FRAMEWORK OF RODS CONFIGURABLE INTO A VARIETY OF SHAPES

[76] Inventor: Ted A. Erikson, 1226 E. Madison Park, Chicago, Ill. 60615

[21] Appl. No.: 33,675

[22] Filed: Apr. 3, 1987

[51] Int. Cl.[4] ..... A63F 9/08; A44C 7/00; A47B 43/00; A47B 97/04

[52] U.S. Cl. ..... 273/155; 63/2; 63/12; 211/195; 248/460; 446/102

[58] Field of Search ..... 273/153 R, 155; 63/2, 63/12; 211/195; 248/460, 462; 434/278; 446/102, 126

[56] References Cited

U.S. PATENT DOCUMENTS

| | | | |
|---|---|---|---|
| 2,881,717 | 4/1959 | Fuller . | |
| 2,905,113 | 9/1959 | Fuller . | |
| 2,914,074 | 11/1959 | Fuller . | |
| 3,450,592 | 6/1969 | Conrad et al. . | |
| 3,458,949 | 8/1969 | Young | 434/278 |
| 3,461,574 | 8/1969 | Larsen et al. . | |
| 3,578,331 | 5/1971 | DeGast | 273/157 R |
| 3,591,012 | 7/1971 | Grady | 211/195 |
| 3,916,559 | 11/1975 | Flowerday | 273/155 X |
| 3,927,489 | 12/1975 | Bernstein | 446/126 X |
| 4,274,222 | 6/1981 | Zahn et al. | 446/126 |

OTHER PUBLICATIONS

Flexohedron Brochure, 2 pages, received 1/25/77, 273-155.

*Primary Examiner*—Anton O. Oechsle

*Attorney, Agent, or Firm*—Wood, Dalton, Phillips, Mason & Rowe

[57] ABSTRACT

A three-dimensional structure defines space in the form of a tetrahedron as the simplest of the five Platonic solids with junction restraints at each of four vertices that allow lineation of size and angulation of shape and form by flexure and frictional slippage, respectively. This structure has use as an educational toy, puzzle, or game; in miniature as jewelry and pendants or support for variable requirements of easels or tables or display racks.

4 Claims, 2 Drawing Sheets

FRAMEWORK OF RODS CONFIGURABLE INTO A VARIETY OF SHAPES

BACKGROUND OF THE INVENTION

This invention relates to a framework of varying angular and linear position of three edges that meet near a common junction. Four such junctions, interconnected by six edges, form a tetrahedron, the simplest space-filling structure of polyhedra. The plurality of polyhedral concepts are evident in previous patents beginning with U.S. Pat. No. 2,682,235 (June 25, 1954) for geodesic building constructions; U.S. Pat. No. 3,461,574 (Aug. 19, 1968) in educational toys; U.S. Pat. No. 3,450,592 (June 17, 1965) as a multiple use geometric shape; U.S. Pat. No. 3,578,331 (May 11, 1971) and U.S. Pat. No. 4,025,106 as a collapsible chair; and U.S. Pat. No. 4,201,807 as an accessory item. These examples, as well as many others, appear to use polyhedral edges in tension, faces as planar blanks, and/or volumes as space-filling blanks. My invention allows edges of a tetrahedral or other polyhedral structures to vary relative lengths and angles in a synergetic manner. The size, form, and shape of the structure is simultaneously integrated into practically infinite variations. None of the patents cited changes size, form, and shape in this manner.

My invention is useful to (1) develop visual-spatial aptitudes as a toy, puzzle, game, etc.; (2) wear as a unique and changeable piece of jewelry as pendant, earrings, etc.; and (3) vary support structures to changing requirements such as tables, chairs, etc.

SUMMARY OF INVENTION

The principal object of the present invention is a structure that angulates and lineates three-dimensional space such that its size, form, and shape are defined within and suggested without. Prototype models have been constructed to demonstrate this concept with the simplest of the five Platonic solids, the tetrahedron. This structure has use as an educational toy, puzzle, or game. In appropriate size, its changeable shape and form find use as jewelry or support structure.

The foregoing and other objects, advantages, and features of the invention and the manner in which the same are accomplished will become more readily apparent upon consideration of the following description of details of this invention, together with drawings and photographs or prototypes which illustrate preferred and exemplary embodiments.

BRIEF DESCRIPTION OF ATTACHMENTS

FIG. 1 discloses a drawing of an assembly of six edges of the basic tetrahedral shape constrained by four junction constraints in lineated form.

FIG. 2 discloses a drawing of the six edges angulated and lineated within the four junction restraints into a regular tetrahedron.

FIG. 3 exhibits various sizes as used for puzzles, display racks, and jewelry.

FIG. 4 displays the variety of size, shape, and form of claimed structure

DETAILED DESCRIPTION USING FIGURES

Figure 1:
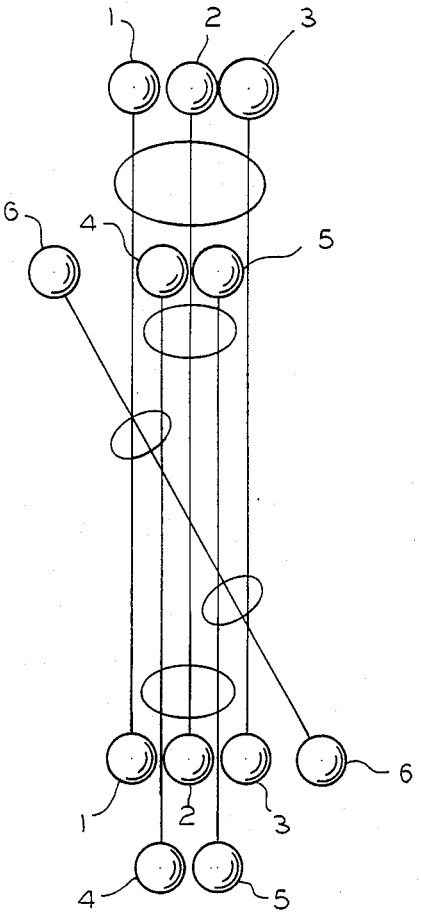

FIG. 1 shows an assembly of one embodiment of connecting six edges, herein designated as control rods of any fixed length and identified by numbers, with junction restraints of any flexible material which allows the junction to angulate, by flexure, and lineate, by appropriate frictional slippage, any stresses that are imposed. Appropriately selected O-rings are one suitable restraint, but other means have been used.

Figure 2:
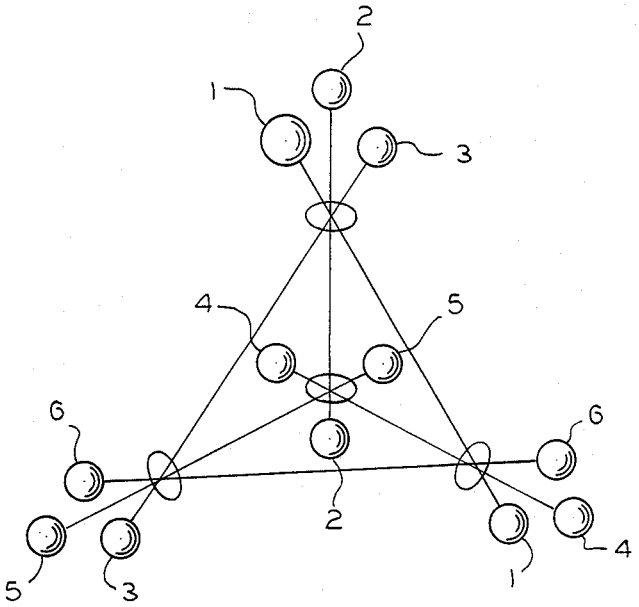

FIG. 2 shows one structure that forms by angulation and lineation of the assembly. The six edges identify an internal space in three dimensions, as well as suggest an external space as identified by four combinations of three edges. The figure shows junction combinations of 1-2-3, 1-4-6, 2-4-5, and 3-5-6, which outline a tetrahedron.

Figure 3:
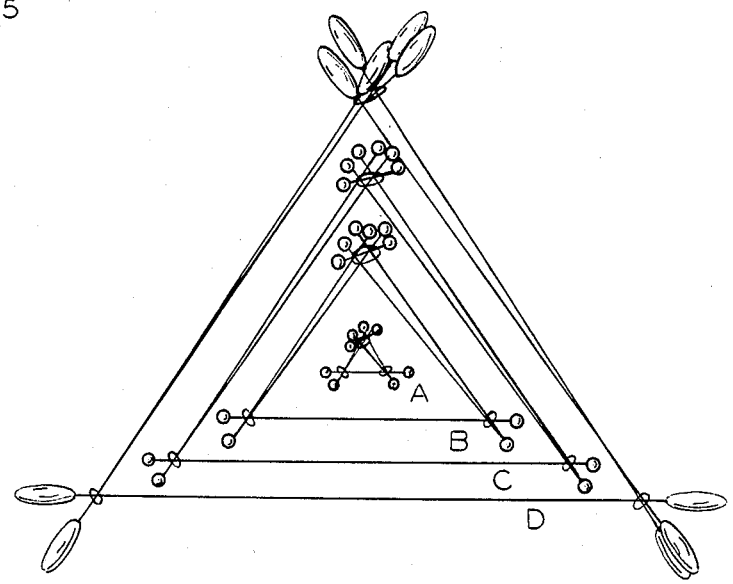
Figure 4:
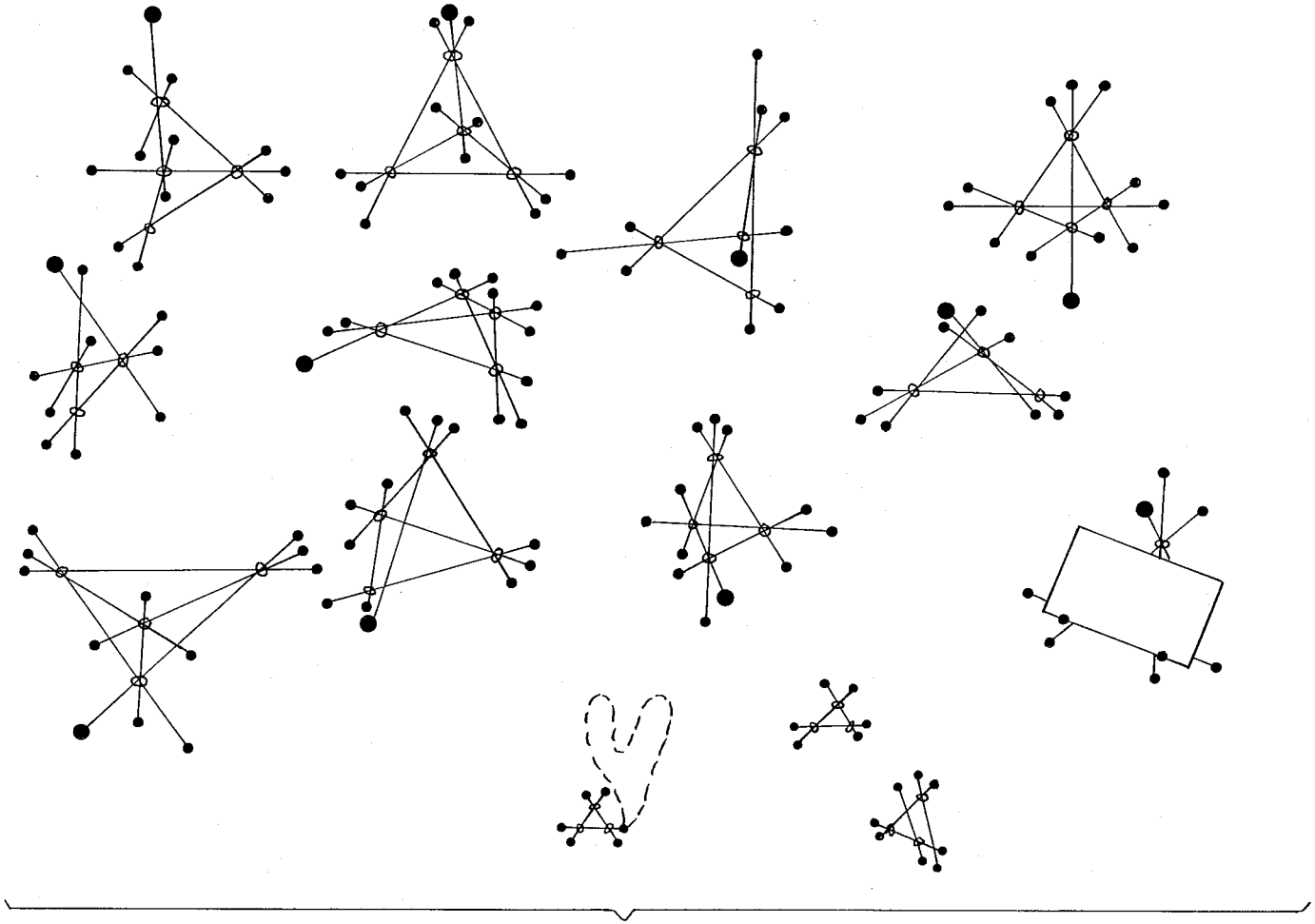

FIG. 4 is a photograph that shows ten combinations of lineation and angulation from assemblies such as FIG. 1. In addition, it shows three exhibits of tetrahedral structures in miniature, but use as pendant or other jewelry, designated as A. Further, it exhibits another use as a support structure, namely an easel, designated as B. FIG. 3 exhibits variation in size from A (miniature as earrings), through B, C, as intermediate to size D, used as a display rack.

What is claimed is:

1. A variable framework comprising six rods and four flexible rings, each of said rods being provided at their extremities with knobs, each of said rings frictionally and slidably encircling a different subset of three of said rods, said knobs each having a diameter greater than the inside diameter of any of said rings, said rods being slidable and articulatable with respect to their associated rings into a plurality of configurations including that of a tetrahedron wherein a ring is disposed adjacent each apex in encircling relation to its associated subset of three rods.

2. A variable framework as defined in claim 1 of a size permitting said framework to be used as an earring, pendant or decorative jewelry item of variable shape.

3. A variable framework as defined in claim 1 of a size such that said framework can serve as a puzzle or educational toy manipulatable into a plurality of configurations.

4. A variable framework as defined in claim 1 so sized as to enable said framework to be used a a variably configurable easel or display rack.

* * * * *